US008526864B2

(12) United States Patent
Nakagawa et al.

(10) Patent No.: US 8,526,864 B2
(45) Date of Patent: Sep. 3, 2013

(54) IMAGE DEVELOPER, PROCESS CARTRIDGE, AND IMAGE FORMING APPARATUS

(75) Inventors: Shuuichi Nakagawa, Osaka (JP); Chiyoshi Nozaki, Shiga (JP); Hideaki Yasunaga, Osaka (JP); Keiichiro Juri, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 283 days.

(21) Appl. No.: 13/071,902

(22) Filed: Mar. 25, 2011

(65) Prior Publication Data

US 2011/0243616 A1 Oct. 6, 2011

(30) Foreign Application Priority Data

Apr. 1, 2010 (JP) ..... 2010-085497

(51) Int. Cl.
*G03G 15/08* (2006.01)

(52) U.S. Cl.
USPC ..... 399/281; 399/283

(58) Field of Classification Search
USPC ..... 399/281, 283, 285, 272, 273, 270
See application file for complete search history.

(56) References Cited

U.S. PATENT DOCUMENTS

| | | | | |
|---|---|---|---|---|
| 5,287,150 | A * | 2/1994 | Kinoshita et al. | 399/281 |
| 5,953,569 | A * | 9/1999 | Ishikawa | 399/281 |
| 6,345,166 | B1 * | 2/2002 | Sakaizawa et al. | 399/283 |
| 7,676,184 | B2 | 3/2010 | Murayama et al. | |
| 7,680,443 | B2 | 3/2010 | Murayama et al. | |
| 7,695,885 | B2 | 4/2010 | Yasunaga et al. | |
| 7,697,874 | B2 * | 4/2010 | Izutani et al. | 399/281 |
| 7,720,428 | B2 | 5/2010 | Hagi et al. | |
| 7,820,348 | B2 | 10/2010 | Hagi et al. | |
| 7,831,182 | B2 | 11/2010 | Konishi et al. | |
| 7,835,652 | B2 | 11/2010 | Konishi et al. | |
| 7,838,193 | B2 | 11/2010 | Hagi et al. | |
| 7,865,118 | B2 | 1/2011 | Nakagawa et al. | |
| 7,873,300 | B2 | 1/2011 | Fuwa et al. | |
| 7,890,033 | B2 | 2/2011 | Murayama et al. | |
| 2006/0280529 | A1 | 12/2006 | Nakagawa et al. | |
| 2007/0065167 | A1 * | 3/2007 | Yamamura | 399/281 X |

(Continued)

FOREIGN PATENT DOCUMENTS

| | | |
|---|---|---|
| JP | 54-43038 | 4/1979 |
| JP | 62-95558 | 5/1987 |

(Continued)

OTHER PUBLICATIONS

Machine translation of JP 2001-249532 A dated Feb. 25, 2013.*

*Primary Examiner* — Sophia S Chen
(74) *Attorney, Agent, or Firm* — Cooper & Dunham LLP

(57) ABSTRACT

An image developer, including a developer container containing a developer developing a latent image on a latent image bearer; a developer bearer bearing the developer, located close to or contacting the latent image bearer; and a developer feeding and collection roller feeding the developer onto the developer bearer and scraping the developer therefrom, rotating while contacting thereto with pressure, wherein the developer feeding and collection roller includes an inner layer formed of an electroconductive foamed rubber; and an outer layer formed of an insulative foamed rubber, and wherein the following relationship is satisfied:

$\alpha \geqq T$ wherein $\alpha$ represents a compression amount of the pressure of the developer feeding and collection roller to the developer bearer; and T represents a thickness of the outer layer, and wherein an offset voltage having a polarity opposite to that of the charged developer is applied to the developer feeding and collection roller.

11 Claims, 4 Drawing Sheets

(56) References Cited

U.S. PATENT DOCUMENTS

| | | | |
|---|---|---|---|
| 2007/0207399 | A1 | 9/2007 | Kadota et al. |
| 2008/0069617 | A1 | 3/2008 | Matsumoto et al. |
| 2008/0101823 | A1 | 5/2008 | Katoh et al. |
| 2008/0131174 | A1 | 6/2008 | Inoue et al. |
| 2008/0175630 | A1 | 7/2008 | Yasunaga et al. |
| 2008/0226356 | A1 | 9/2008 | Yasunaga et al. |
| 2008/0227009 | A1 | 9/2008 | Fuwa et al. |
| 2008/0304875 | A1 | 12/2008 | Katoh et al. |
| 2009/0041512 | A1 | 2/2009 | Murayama et al. |
| 2009/0297230 | A1 * | 12/2009 | Koyanagi et al. ..... 399/281 |
| 2010/0028057 | A1 | 2/2010 | Yamada et al. |
| 2010/0150609 | A1 | 6/2010 | Nozaki et al. |

FOREIGN PATENT DOCUMENTS

| | | | |
|---|---|---|---|
| JP | 5-333679 | | 12/1993 |
| JP | 2001-051492 | A * | 2/2001 |
| JP | 2001-249532 | | 9/2001 |

* cited by examiner

IMAGE DEVELOPER, PROCESS CARTRIDGE, AND IMAGE FORMING APPARATUS

BACKGROUND OF THE INVENTION

1. Field of the Invention

The present invention relates to an image developer used in electrophotographic methods for copiers, printers and facsimiles, etc., and more particularly to a non-magnetic one-component image developer capable of both applying a toner onto a developing roller and scraping the toner therefrom. In addition, the present invention relates to a process cartridge and image forming apparatus using the image developer.

2. Description of the Related Art

An image developer in an image forming apparatus rotates a developing roller bearing toner to feed the toner to a place facing a photoreceptor as an image bearer, and develops an electrostatic latent image formed on the surface of the photoreceptor with the toner.

It is important to form a thin toner layer on the developing roller to produce high-quality images, and various methods of forming the thin toner layer are disclosed.

Japanese published unexamined application No. 54-43038 (JP-S54-43038-A) discloses a method of contacting an elastic rubber or metallic blade to a developing roller, passing toner through a gap therebetween to form a thin toner layer on the developing roller, and charging the toner.

Therefore, a toner feeder is needed to feed a required quantity of toner onto the developing roller. Methods of contacting a toner feeding and collection roller formed of a brush material or a foamed rubber material to the developing roller to apply the toner thereto are known.

However, besides a capability of feeding a toner thereto the toner feeding and collection roller also has a collection capability of scraping off undeveloped toner remaining on the developing roller after image development. When this capability is insufficient, the result is that charged and undeveloped toner and uncharged toner are mixed together on the developing roller. The difference in charge between the two types of toners causes a difference in the resultant image density, i.e., production of ghost images.

Methods of electrostatically scraping off toner are known, in which the toner feeding and collection roller is formed of a semiconductive foamed elastic material and a DC bias voltage having a polarity opposite to that of the charged toner is applied to the roller to increase the ability to scrape away the toner.

However, the DC bias voltage not only increases the capability of scraping away toner but also disturbs the capability of applying toner to the developing roller in the first place. Therefore, when images having high image density are continuously produced, the supply of toner fed onto the developing roller becomes inadequate, resulting in production of images having lower image density and blurred images.

Japanese published unexamined application No. 2001-249532 (JP-2001-249532-A) discloses a non-magnetic one-component image developer in which an AC bias voltage is applied to a toner feeding and collection roller formed of two foamed rubber layers having different volume resistivities for the purpose of preventing ghost images by replacing an uncharged toner on the feeding and collection roller with an undeveloped toner remaining on a developing roller. This method oscillates the toners in an alternating electric field formed between the developing roller and the feeding and collection roller to alternate the toners.

However, the AC bias voltage needs to have a desired waveform, and for this, the feeding and collection roller needs to include a lower layer having a volume resistivity not greater than $10^5$ Ω·cm and an upper layer having a volume resistivity not less than $10^6$ Ω·cm. Therefore, it is difficult to control the volume resistivities, resulting in higher cost.

To prevent ghost images from being produced, the AC bias voltage must be applied to the feeding and collection roller, and its volume resistivity is just a supplementary condition for effecting the AC bias voltage. However, the AC bias voltage causes cyclic uneven image density because the adherence of toner onto a developing roller changes according to the oscillation cycle, and an electrical source for generating the voltage is disadvantageously expensive.

Meanwhile, a DC bias voltage does not solve the problem.

Japanese published unexamined application No. 05-333679 (JP-05-333679-A) discloses an image developer in which a toner feeding roller and a toner collection roller are separately located, and a bias voltage feeding a toner to a developing roller is applied to the toner feeing roller and a bias voltage scraping the toner therefrom is applied to the collection roller to provide both feeding and collection capabilities. However, a configuration in which plural rollers contact each other around a developing roller is complicated and difficult to downsize.

For these reasons, a need exists for a downsizable image developer having a simple configuration.

SUMMARY OF THE INVENTION

Accordingly, an object of the present invention is to provide a non-magnetic one-component image developer having both capabilities of feeding a toner onto a developing roller and scraping the toner therefrom to produce high-quality images without ghost images, deterioration of image density and blurred images.

Another object of the present invention is to provide an image forming apparatus using the image developer.

A further object of the present invention is to provide a process cartridge using the image developer.

To achieve such objects, the present invention contemplates the provision of an image developer, comprising:

a developer container configured to contain a developer developing a latent image on a latent image bearer;

a developer bearer configured to bear the developer, located close to or contacting the latent image bearer; and a developer feeding and collection roller configured to feed the developer onto the developer bearer and scrape the developer therefrom, rotating while contacting thereto with pressure, wherein the developer feeding and collection roller comprises:

an inner layer formed of an electroconductive foamed rubber; and an outer layer formed of an insulative foamed rubber, the following relationship is satisfied:

$$\alpha \geqq T$$

wherein α represents a compression amount of the pressure of the developer feeding and collection roller to the developer bearer; and T represents a thickness of the outer layer, and an offset voltage having a polarity opposite to that of the charged developer is applied to the developer feeding and collection roller.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
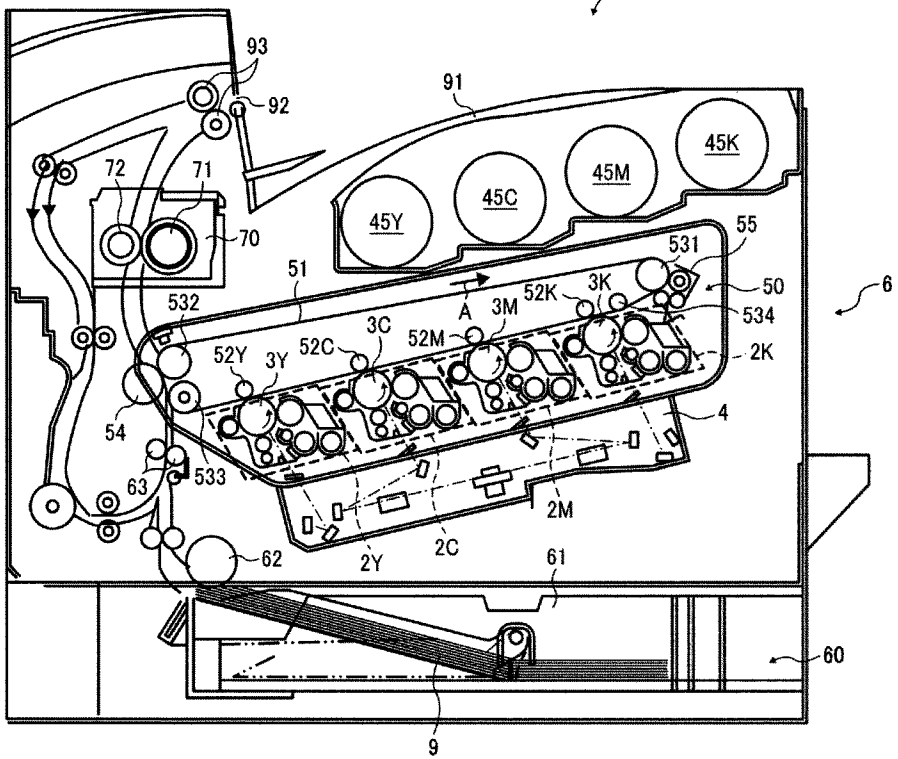
FIG. 1 is a schematic view illustrating an embodiment of the image forming apparatus including the image developer of the present invention.

Generally, the present invention provides a non-magnetic one-component image developer having both capabilities of feeding a toner onto a developing roller and scraping the toner therefrom to produce high-quality images without ghost images, deterioration of image density and blurred images. More particularly, the present invention relates to an image developer, comprising:

a developer container configured to contain a developer developing a latent image on a latent image bearer;

a developer bearer configured to bear the developer, located close to or contacting the latent image bearer; and a developer feeding and collection roller configured to feed the developer onto the developer bearer and scrape the developer therefrom, rotating while contacting thereto with pressure, wherein the developer feeding and collection roller comprises:

an inner layer formed of an electroconductive foamed rubber; and an outer layer formed of an insulative foamed rubber, the following relationship is satisfied:

$$\alpha \geqq T$$

wherein $\alpha$ represents a compression amount of the pressure of the developer feeding and collection roller to the developer bearer; and T represents a thickness of the outer layer, and an offset voltage having a polarity opposite to that of the charged developer is applied to the developer feeding and collection roller.

A preferred embodiment of the present invention will be explained, referring to the drawings.

FIG. 1 is a schematic view illustrating an embodiment of the image forming apparatus including the image developer of the present invention.

Figure 2:
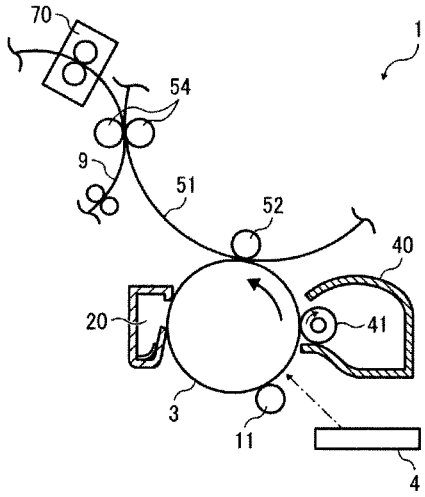
FIG. 2 is a schematic view illustrating a configuration adjacent to a photoreceptor of the image forming apparatus including the image developer of the present invention.

FIG. 2 is a schematic view illustrating a configuration adjacent to a photoreceptor of the image forming apparatus including the image developer of the present invention.

An image forming apparatus 1 including plural photoreceptors 3K, 3M, 3C and 3Y will be explained, but the present invention is not limited thereto. Image forming units 2 for them have the same configuration, which are controlled according to toner quantities of them, and all the units are not explained.

The image forming apparatus 1 includes an image former 6 including a photoreceptor 3 which is an image bearer to form a toner image at the top and a paper feeder 60 at the bottom. In addition, the image forming apparatus includes a paper discharge tray 91 onto which a recording member 9 on which an image has been formed is discharged through a delivery port 92 via paper ejecting rollers 93, at an upper portion thereof.

The image former 6 includes four tandem process cartridges for each yellow (Y), magenta (M), cyan (C) and black (K) color along a transferer 50.

As FIG. 1 shows, the image forming apparatus 1 of the present invention has the four process cartridges 2.

Any of the process cartridges 2 has the same configuration, and Y, M, C and K representing colors are omitted in FIG. 1. Each of the process cartridges 2 has a photoreceptor 3, and a charger 10 charging the surface of the photoreceptor 3, an image developer 40 developing a latent image formed on the surface of the photoreceptor 3 with each color toner to form a toner image, a lubricator 30 applying a lubricant on the surface of the photoreceptor 3 and a cleaner 20 cleaning the surface of the photoreceptor 3 after the toner image is transferred around the photoreceptor 3.

A transferer 50 is an endless belt formed of a middle-resistive substrate made of a heat-resistant material such as polyimide and polyamide, and includes an intermediate transfer belt 51 as an intermediate transferer rotating in an arrow A direction, suspended and supported by four rollers 531, 532, 533 and 534.

An irradiator 4 irradiating the charged surface of each photoreceptor 3 based on each color image data to form a latent image is located below each of the four process cartridges 2. A first transfer roller 52 as a first transferer first transferring the toner image on the photoreceptor 3 onto the intermediate transfer belt 51 is located at apposition facing each of the photoreceptors 3 across the intermediate transfer belt 51. The first transfer roller 52 is connected to an unillustrated electrical source and a predetermined voltage is applied thereto.

A second transfer roller 54 as a second transferer contacts with pressure an outside of a part of the intermediate transfer belt 51 supported by the support roller 532. The second transfer roller 54 is connected with an unillustrated electrical source and a predetermined voltage is applied thereto. A contact point between the second transfer roller 54 and the intermediate transfer belt 51 is a second transfer site where a toner image on the intermediate transfer belt 51 is transferred onto a recording member 9.

An intermediate transfer belt cleaner 55 cleaning the surface of the intermediate transfer belt 51 after the second transfer is located outside of a part of the intermediate transfer belt 51 supported by the support roller 531.

A fixer 70 semipermanently fixing a toner image on the recording member 9 thereon is located above the second transfer site. The fixer 70 includes a fixing roller 71 and a pressure roller 72 including a halogen heater, located in contact therewith. An endless fixing belt suspended around a heat roller including a halogen heater and a fixing roller may be used instead of the fixing roller 71.

The image forming apparatus include a paper feeder 60 loading the recording member 9 and feeding the recording member 9 (from tray 61 via pickup roller 62 and resist rollers 63) to the second transfer site at the bottom.

The photoreceptor 3 includes those using metallic materials such as amorphous silicone and selenium and those using organic photosensitive materials. The organic photoreceptor includes a filler-dispersed resin layer, a photosensitive layer including a charge generation layer and a charge transport layer and a protection layer having a filler-dispersed surface on an electroconductive substrate. The photosensitive layer may be a single-layered photosensitive layer including a charge generation material and a charge transport material, but a multilayered photosensitive layer including the charge generation layer (CGL) and the charge transport layer (CTL) has better sensitivity and durability.

The charge generation layer can be formed by dispersing a charge transportable pigment optionally with a charge generation material in a solvent by a ball mill, an attritor, a sand mill, an ultrasonic, etc., to prepare a dispersion, coating the dispersion on an electroconductive substrate, and drying the dispersion. Specific examples of binder resins used in the CGL include polyamide, polyurethane, epoxy resins, polyketone, polycarbonate, silicone resins, acrylic resins, polyvinylbutyral, polyvinylformal, polyvinylketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, etc. The CGL preferably includes the binder resin in an amount of from 0 to 500 parts by weight, and preferably from 10 to 300 parts by weight, per 100 parts by weight of the charge generation material therein.

The CTL can be formed by dissolving or dispersing a charge transport material and a binder resin in a proper solvent coating the coating liquid on the CGL and drying the coated liquid. The charge transport material includes a positive-hole transport material and an electron transport material. Specific examples of the binder resin include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins and alkyd resins.

A protection layer may be formed on the photosensitive layer to improve durability of the resultant photoreceptor. Specific examples of resins used in the protection layer include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyarylate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. Particularly, polycarbonate and polyarylate are most preferably used. Besides, the protection layer may include fluorine-containing resins such as polytetrafluoroethylene and silicone resins, and those including dispersed inorganic fillers such as titanium oxide, tin oxide, kalium titanate and silica, and organic fillers. The concentration of the fillers in the protection layer depends on the fillers and electrophotographic processes using the photoreceptor 3, but preferably from 5 to 50%, and more preferably from 10 to 30% by weight, based on total solid contents at the outermost surface of the protection layer.

The charger 10 uses discharge methods such as a corotron method of suspending with tension thin metallic wires such as tungsten and molybdenum or their metal-plated wires in an aluminum case, or a scorotron method of suspending with tension grid metallic wires. Besides, roller methods of contacting or facing with a small gap a rotating roller to a photoreceptor can be used.

As a charging member, a charging roller 11 formed of an electroconductive metal core coated with a middle-resistive elastic layer is equipped.

The charging roller 11 is connected with an unillustrated electrical source, and a predetermined voltage is applied thereto. The charging roller 11 contacts the photoreceptor 3. Even when contacting the photoreceptor 3, its circular-formed cross-section has a part located close thereto. The part discharges to charge the photoreceptor 3. In the present invention, a contact charging roller cleaner 12 cleans the surface of the charging roller 11 while contacting thereto, and ozone is generated less, which complies with the present needs considering the environment.

The predetermined voltage may only be a DC voltage, but is preferably a DC voltage overlapped with an AC voltage. The DC voltage overlapped with an AC voltage can more uniformly charge the surface of the photoreceptor 3. The contact charger 10 charges the photoreceptor 3 by contacting the charging roller 11 thereto, and has advantages such as less generation of discharged products, less electricity because of its low application voltage and simpler insulating design than conventional corona charges. In addition, ozone and nitroxides can be reduced.

The charging roller 11 may be located close to the photoreceptor 3 with a small gap. The small gap can be formed by winding a spacer having a specific thickness on both non-image forming ends of the charging roller 11 and contacting the surface of the spacer to the surface of the photoreceptor 3.

The image developer 40 includes a developing roller 41 bearing and transferring a developer at a position facing the photoreceptor 3. A roller 44 transferring the developer from a toner bottle while stirring the developer and a roller 43 scooping up the developer into the developer roller 41 are located below the developer roller 41. A developer transferred by the developing roller 41 is regulated by a regulation member 42 to have a layer having a predetermined thickness and borne by the developing roller 41. The developing roller 41 transfers a developer to feed a toner to a latent image on the photoreceptor 3 while traveling in the same direction thereof at a position facing the photoreceptor 3.

As FIG. 1 shows, toner cartridges 45Y, 45C, 45M and 45K including unused each color toner are detachably contained in the space above the photoreceptor 3. An unillustrated toner feeder such as mohno pumps and air pumps feeds a toner to each the image developers 40 when necessary. Particularly, the toner cartridge 45K for a black toner can have a large capacity.

The image developer 40 will further be explained later.

The cleaner 20 has a mechanism contacting a cleaning blade 21 to the photoreceptor 3 and separating the cleaning blade 21 therefrom. A controller of the image forming apparatus can contact the cleaning blade 21 to photoreceptor 3 and separate the cleaning blade 21 therefrom. The cleaning blade 21 contacts the photoreceptor 3 in a counter direction to remove a toner remaining thereon and additives such as talc, kaolin and calcium carbonate therefrom. The removed toner is transferred by a waste toner collection coil 22 to an unillustrated waste toner container and reserved therein.

The unillustrated lubricator includes a solid lubricant contained in a fixed case, an application brush contacting and scraping the lubricant to apply the lubricant to the photoreceptor 3, and a lubricant application blade leveling the lubricant applied thereon by the application brush. The solid lubricant has the shape of a rectangular parallelepiped, and is biased to the application brush by a pressure spring. The solid lubricant is scraped by the application brush and consumed, and decreases in thickness, but constantly contacts the application brush because of being pressed by the pressure spring. The application brush applies the scraped lubricant while rotating to the surface of the photoreceptor 3.

The lubricant in the image forming apparatus 1 includes a fatty acid metal salt. The fatty acid metal salt (A) is broken by a charge current, which prevents the surface of the photoreceptor 3 from being broken, and the inorganic lubricant which is not breakable by the charge current maintains lubricity of the photoreceptor 3.

Specific examples of the fatty acid metal salt (A) include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate and their mixtures. In the present invention, zinc stearate is most preferably used because of having good film formability.

As FIG. 2 shows, the image forming apparatus 1 is used for monochrome electrophotographic copiers, facsimiles, laser printers and full-color laser printers, and includes the image developer 40 of the present invention. The photoreceptor 3 is located close to the image developer 40 and rotates in an arrow direction. The charging roller 11 contacts the surface of the photoreceptor 3 with pressure and is driven to rotate by the rotation of the photoreceptor 3. The charging roller 11 is applied with a predetermined bias by an unillustrated high-voltage electrical source, and uniformly charges the surface of the photoreceptor 3 to have a predetermined potential. Then, the photoreceptor 3 forms an electrostatic latent image pattern on its surface in compliance with irradiation given by the irradiator 4. The image developer 40 includes the developing roller 41 contacting the surface of the photoreceptor 3 with pressure, and which is applied with a predetermined developing bias by an unillustrated high-voltage electrical source. A toner fed on the developing roller 41 adheres to the electrostatic latent image pattern on the surface of the photoreceptor 3 to form a toner image. The first transfer roller 52 is applied with a first transfer bias by an unillustrated high-voltage electrical source, and the toner image on the surface of the photoreceptor 3 is transferred onto the surface of the intermediate transfer belt 51. The intermediate transfer belt 51 is driven to rotate by an unillustrated drive motor in an arrow direction. The toner image transferred onto the intermediate transfer belt 51 is transferred onto the recording member 9 as a transfer material when the second transfer roller 54 is applied with a predetermined voltage, and is fixed by the fixer 70 thereon and the recording member 9 the toner image is fixed on is produced. The cleaner 20 cleans an residual toner on the surface of the photoreceptor 3.

The toner as the developer is a non-magnetic toner including a colorant and not including a magnetic material. However, the toner may be a magnetic toner including a magnetic material besides or instead of the colorant.

The toner includes a binder resin and a colorant as essential components, and an external additive assisting fluidity, developability and chargeability of the toner. The toner may include a release agent, a charge controlling agent and a plasticizer when necessary.

The binder resin includes polyester resins, polyurethane resins, polyurea resins, epoxy resins, vinyl resins, etc. Hybrid resins formed of chemically-combined different resins may be used. Reactive functional groups may be introduced to terminals or side chains of resins, and combined with each other in the process of preparing a toner to elongate.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

The toner may include a magnetic material besides or instead of the colorant. Specific examples of magnetic material include (1) magnetic iron oxides such as magnetite, hematite and ferrite and iron oxides including other metal oxides; (2) metals such as iron, cobalt and nickel or their metal alloys with metals such as aluminum, cobalt, copper, lead, magnesium, tin, zinc, antimony, beryllium, bismuth, cadmium, calcium, manganese, selenium, titanium, tungsten and vanadium; and (3) their mixtures.

Specific examples thereof include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, an iron powder, a cobalt powder, a nickel powder, etc. These can be used alone or in combination. Particularly, fine powders of $Fe_3O_4$ and $\gamma$-$Fe_2O_3$ are preferably used.

Known inorganic particulate materials and particulate polymers can preferably be used as the external additive. The external additive preferably has an average primary particle diameter of from 5 nm to 2 μm, and more preferably from 5 to 500 nm. In addition, the external additive preferably has a specific surface area of from 20 to 500 $m^2/g$ when measured by a BET method. The toner preferably includes the external additive in an amount of from 0.01 to 5% by weight, and more preferably from 0.01 to 2.0% by weight.

Specific examples of the inorganic particulate materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, their mixtures, etc.

Specific examples of the particulate polymers include polystyrene, ester methacrylate and ester acrylate copolymers obtained by soap-free emulsion polymerization, suspension polymerization and dispersion polymerization; silicone, benzoguanamine and nylon (registered trademark) obtained by polycondensation; and those of thermosetting resins.

A surface treatment agent can increase the hydrophobicity of these fluidizers and prevent deterioration of fluidity and chargeability of the resultant toner even in high humidity. Specific preferred examples of the surface treatment agent include silane coupling agents, silylating agents, silane coupling agents having an alkyl fluoride group, organic titanate coupling agents, aluminium coupling agents silicone oils and modified silicone oils.

Known release agents can be used in the present invention. Specific examples of the wax include known waxes, e.g., polyolefin waxes such as polyethylene wax and polypropylene wax; long chain carbon hydrides such as paraffin wax and sasol wax; and waxes including carbonyl groups. Specific examples of the waxes including carbonyl groups include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. In the present invention, waxes having low polarity are preferably used. Specific examples thereof include hydrocarbon waxes such as polyethylene waxes, polypropylene waxes, paraffin waxes, sasol waxes, microcrystalline waxes and Fischer-Tropsch waxes.

The toner preferably includes a wax in an amount of from 2 to 5% by weight. When less than 2% by weight, the toner deteriorates in releasability and offset prevention. When greater than 5% by weight, the wax melts at low temperature, exudes from the toner with machine heat energy, e.g., when stirred in the image developer, and adheres to the developing roller 41 and the photoreceptor 3, resulting in image noises. In addition, the release agent expands outside of an image area when printed on an OHP sheet, resulting in projected image noises. The wax preferably has an endothermic peak of from 60 to 90° C., and more preferably from 65 to 80° C. when heated, when measured by a differential scanning calorimeter. When less than 60° C., the toner deteriorates in fluidity and heat-resistant preservability. When greater than 90° C., the toner deteriorates in fixability.

Further, the wax preferably has a half-value width of the endothermic peak not greater than 8° C., and more preferably not greater than 6° C. when heated, when measured by a differential scanning calorimeter. When greater than 8° C., i.e., the endothermic peak is broad, the toner deteriorates in fluidity and heat-resistant preservability.

The toner may include a charge controlling agent when necessary. Specific examples of the charge controlling agent include, but are not limited to, known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, copper phthalocyanine, perylene, quinacridone, azo pigments and polymers having a functional group such as a sulfonate group, a carboxyl group, a quaternary ammonium group, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.

Methods of preparing a toner are not particularly limited, and include known wet granulating methods such as solution suspension methods, suspension polymerization methods and emulsion aggregation methods, and dry pulverization methods of melting and kneading a binder resin, etc., crushing and pulverizing, and classifying.

Figure 3:
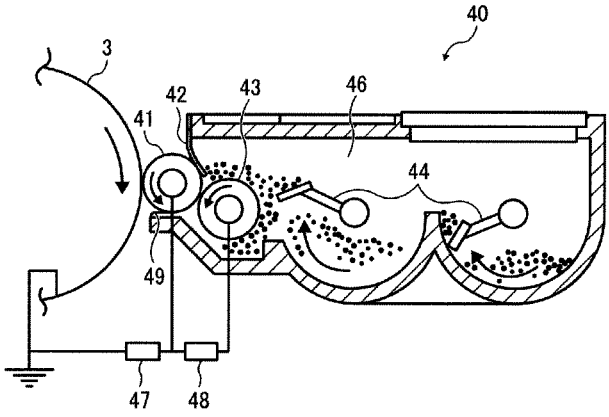
FIG. 3 is a schematic view illustrating an embodiment of the image developer of the present invention.

FIG. 3 is a schematic view illustrating an embodiment of the image developer of the present invention.

The image developer 40 includes a toner container 46 containing a toner, the plural toner transfer members 44, the developing roller 41, the feeding and collection roller 43 contacting the developing roller 41, and the layer regulation member 42. The developing roller 41 is applied with a developing bias and the toner travels according to an electric field pattern formed between the surface of the photoreceptor 3 and the developing roller 41 to form a toner image on the surface of the photoreceptor 3.

The toner transfer members 44 in the toner container 46 rotates in clockwise direction to transfer the contained toner to the feeding and collection roller 43.

The feeding and collection roller 43 is coated with a foamed material having cells and contacts the developing roller 41 with pressure. The feeding and collection roller 43 rotates in anti-clockwise direction and transfers the toner adhering to the surface thereof to a position facing the developing roller 41. The foamed material is deformed when the feeding and collection roller 43 contacts the developing roller 41 with pressure to apply the toner adhering to the surface thereof to the surface of the developing roller 41.

The feeding and collection roller 43 is applied with a collection bias from a collection bias electrical source 48 to form a collection electric field between the developing roller 41 and the feeding and collection roller 43. The collection bias is an offset DC voltage having a polarity opposite to that of the charged toner. The collection bias applied to the feeding and collection roller 43 is preferably a DC voltage overlapped with an AC voltage. When the toner adhering to the surface of the developing roller 41 is electrostatically oscillated, the toner is more responsive to the collection bias electric field and is more efficiently scraped from the developing roller 41.

An electroconductive foamed material is used to activate the collection bias.

The layer regulation member 42 is formed of a metallic plate spring made of SUS304CSP, SUS301CSP or a phosphor bronze, etc. The free end thereof contacts the surface of the developing roller 41 at pressure of from 10 to 100 N/m to thin and frictionally charge the toner layer having passed thereunder.

The developing roller 41 rotates in anti-clockwise direction, holds the toner applied by the feeding and collection roller 43 on its surface, and transfers the toner to a position facing the layer regulation member 42 and the photoreceptor 3. The developing roller 41 preferably has a surface roughness of from 0.2 to 2.0 μm to hold the toner on the surface in a required amount.

The developing roller 41 is a roller coated with an elastic rubber layer and has a hardness not greater than 50° when measured by JIS-A to maintain contact with the photoreceptor 3.

In the present invention, the developing roller 41 contacts the photoreceptor 3 at a constant pressure without an excessive one, and the toner is stably fed from the feeding and collection roller 43 to the developing roller 41 without variation due to the environment and age to produce images having stable image density because the feeding and collection roller 43 has an ASKER C hardness of from 8 to 30.

Further in the present invention, the developing roller 41 includes a surface layer formed of a material chargeable to have a polarity opposite to that of the toner because of being frictionally charged by the layer regulation member 42. The photoreceptor 3 rotates in clockwise direction, and therefore the surface of the developing roller 41 travels in the same travelling direction of the photoreceptor 3 at a position facing the photoreceptor 3. The developing roller 41 is applied with a developing bias by a developing bias electrical source 47 to form a developing electric field between the electrostatic latent image pattern on the photoreceptor 3 and the developing roller 41. The charged toner travels to the surface of the photoreceptor 3 according to the developing electric field to be developed. The developing roller 41 is semiconductive, including an elastic rubber layer and a surface layer totally having an electrical resistance of from $10^3$ to $10^{10}\Omega$ to activate the developing bias. An entrance seal 49 contacts the developing roller 41 to seal the toner so as not to leak out from the image developer 40 at a position where the undeveloped toner remaining on the developing roller 41 returns to the toner container 46. The developing roller 41 and the photoreceptor 3 contact each other, but may not contact each other. The photoreceptor 3 may have the shape of a drum or a belt.

Figure 4:
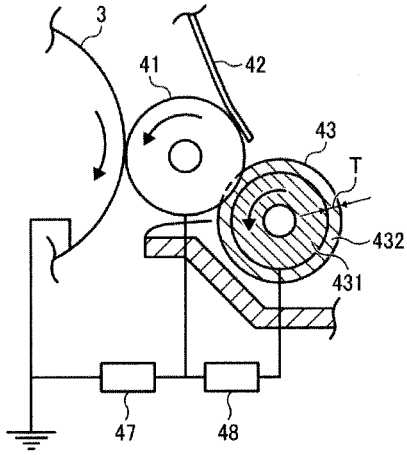
FIG. 4 is a schematic view illustrating a main part of the image developer of the present invention in FIG. 3.

FIG. 4 is a schematic view illustrating a main part of the image developer of the present invention.

The feeding and collection roller 43 includes an electroconductive foamed rubber layer 431 on the outer circumferential of a metallic shaft, and further an insulative foamed rubber layer 432 on the electroconductive foamed rubber layer 431. The insulative foamed rubber layer 432 is compressed to access the electroconductive foamed rubber layer 431 to the surface of the developing roller 41 to activate the collection bias to electrostatically scrape off the toner. The feeding and collection roller 43 contacts the developing roller 41, and when they are rotated so as to travel in opposite directions each other at the contact point. At the entrance of the contact point, the toner transferred by the feeding and collection roller 43 is flicked out from the feeding and collection roller 43 by collision with the developing roller 41 and compression of the foamed rubber layer and applied to the surface of the developing roller 41. Meanwhile, at the center of the contact point, the foamed rubber layer is compressed most and has a maximum restoring force, and where most of the undeveloped toner is scraped off. When a DC bias voltage is applied to the feeding and collection roller 43 in a scraping direction, at the center of the contact point, a bias electric field is activated to electrostatically scrape off a toner, and at the entrance of the contact point, a bias electric field is not activated so as not to prevent a toner from being applied. The feeding and collection roller 43 including the electroconductive foamed rubber layer 431 having electroconductivity as a lower layer and the insulative foamed rubber layer 432 having insulativity as an upper layer contacts the developing roller 41. When the compression amount is not less than the thickness of the upper layer, the upper layer crushes and the lower layer accesses the developing roller 41 at the center of the contact point, and the bias is activated to electrostatically scrape the toner. The insulative upper layer blocks the bias at the entrance of the contact point and the toner is applied as it is.

The inner electroconductive foamed rubber layer 431 is a foamed polyurethane rubber in which an electroconductive material is dispersed, having an independent bubble structure. The electroconductive foamed rubber layer 431 having an independent bubble structure can prevent a toner from entering the electroconductive foamed rubber layer 431, and the feeding and collection roller 43 can maintain its rubber elasticity. When the insulative foamed rubber layer 432 is a foamed rubber having an independent bubble structure, cell walls crushed by compression separate the developing roller 41 from the electroconductive foamed rubber layer 431, resulting in insufficient effect of the collection bias. This is because most of the cell walls penetrate through the electroconductive foamed rubber layer 431 are easy to crush when compressed. Therefore, the electroconductive foamed rubber layer 431 is accessed to the surface of the developing roller 41 to form a sufficient collection electric field.

A polyurethane foam having a foamed skeleton structure is most suitable for a foamed rubber material having a communicated bubble structure used for the insulative foamed rubber layer 432. Even if the foamed rubber hardness is low, a compressed residual ratio can be small. Therefore, the pressure at the contact point is stable even though time passes, and the toner can stably be applied to the developing roller 41 from the feeding and collection roller 43 even after stored and used for long periods. Besides the polyurethane rubber, epichlorohydrin rubber, silicon rubber, EPD rubbers in which an electroconductive material such as carbon is dispersed, having a volume resistivity of from $10^2$ to $10^6$ Ω·cm, can also be used. The outer insulative foamed rubber layer 432 has a larger average cell diameter than the inner electroconductive foamed rubber layer 431. When the electroconductive foamed rubber layer 431 is more easy to crush by compression than the insulative foamed rubber layer 432, only the electroconductive foamed rubber layer 431 is deformed by compression and the insulative foamed rubber layer 432 scarcely compressed, resulting in difficulty of obtaining an effect of the collection bias. When the insulative foamed rubber layer 432 is more easy to crush by compression than the electroconductive foamed rubber layer 431, the electroconductive foamed rubber layer 431 is easy to access the surface of the developing roller 41 and a sufficient collection electric field can be formed.

Figure 5:
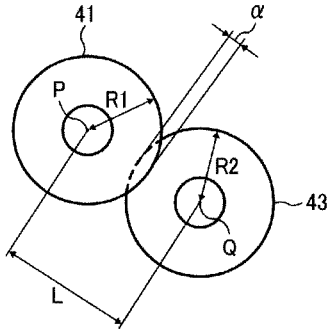
FIG. 5 is a schematic view illustrating a contact status between the developing roller and the feeding and collection roller of the image developer of the present invention in FIG. 4.

FIG. 5 is a schematic view illustrating a contact status between the developing roller and the feeding and collection roller of the image developer of the present invention. AS FIG. 5 shows, the feeding and collection roller 43 contacts the surface of the developing roller 41. When the developing roller 41 has an elastic layer formed of a rubber having a hardness higher than that of the foamed rubber used for the feeding and collection roller 43, the foamed rubber of the feeding and collection roller 43 is compressed at the contact point. When a distance L between an axial center P of the developing roller 41 and an axial center Q of the feeding and collection roller 43 is shorter than a total of a radius R1 of the developing roller 41 and a radius R2 of the feeding and collection roller 43 by α, the feeding and collection roller 43 has a compression amount of α at the contact point.

As shown in FIG. 5, when the insulative foamed rubber layer 432 has a thickness T, the compression amount α is larger than the thickness T. Then, almost all the insulative foamed rubber layer 432 is crushed by compression, and the insulative foamed rubber layer 432 substantially has a minimum thickness almost 0 at the center of the contact point.

When the electroconductive foamed rubber layer 431 is more easy to crush than the insulative foamed rubber layer 432, only the electroconductive foamed rubber layer 431 is deformed by compression and the insulative foamed rubber layer 432 is scarcely compressed, resulting in difficulty of obtaining an effect of the collection bias. When the insulative foamed rubber layer 432 is more easy to crush than the electroconductive foamed rubber layer 431, the compression amount α is larger than the thickness T and the electroconductive foamed rubber layer 431 is easy to access the surface of the developing roller 41 to form a sufficient collection electric field.

Further, the feeding and collection roller 43 is applied with a collection bias voltage from the collection bias electrical source 48 electrically connected thereto through the axis. The outermost circumferential surface of the electroconductive foamed rubber layer 431 has potential equal to the collection bias voltage, and a strong collection electric field is formed at the center of the contact point due to a potential difference with the surface of the developing roller 41, which can electrostatically scrape a toner. At the entrance and exit of the contact point, the collection electric field can extremely be weakened because the developing roller 41 is separate from the electroconductive foamed rubber layer 431 through the insulative foamed rubber layer 432, which does not prevent a toner from being applied. Therefore, the toner is applicable and scrapable.

Therefore, electroconductivity is imparted only to the lower layer of the foamed rubber of the feeding and collection roller 43 having an insulative upper layer used in the image developer 40 contacts the developing roller 41, and a compression amount by the contact is not less than a thickness of the upper insulative foamed rubber layer 432. When a bias voltage in a scrape direction is applied to the feeding and collection roller 43, the bias voltage is activated and the toner is electrostatically scraped because the upper layer is crushed and the lower layer accesses the developing roller 41 at the center of the contact point. At the entrance of the contact point, the upper insulative foamed rubber layer 432 blocks the bias and the toner is applied as it is.

Figure 6:
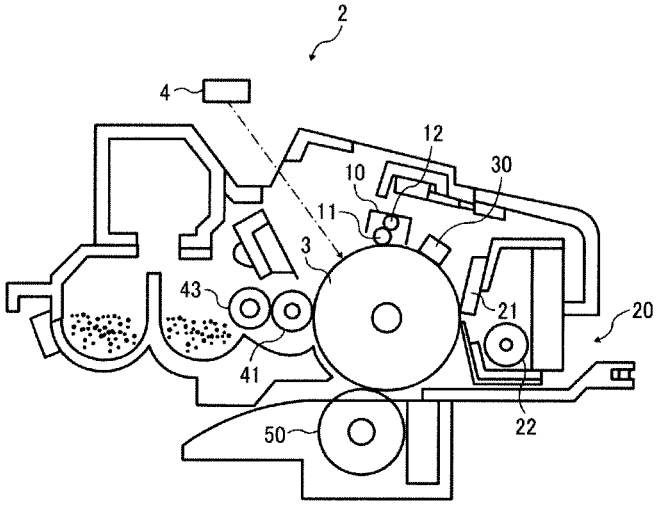
FIG. 6 is a schematic view illustrating an embodiment of the process cartridge including the image developer of the present invention.

FIG. 6 is a schematic view illustrating an embodiment of the process cartridge including the image developer of the present invention.

A process cartridge 2 can detachably be installed in the image forming apparatus 1, and includes at least the photoreceptor 3 bearing an electrostatic latent image as an electrostatic latent image bearer and the image developer 40 developing the electrostatic latent image with a developer to form a visual image.

Further, the process cartridge in FIG. 6 includes the charger 10 charging the surface of the photoreceptor 3, a lubricator 30 applying a lubricant to the surface thereof and a cleaner 20 cleaning the surface thereof after the toner image is transferred around the photoreceptor 3, and preferably includes the lubricator 30.

The process cartridge has good installability, ease of maintenance and good positional precision of the image developer 30, the charger 10, the cleaner 20, etc.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-085497 filed on Apr. 1, 2010, the entire contents of which are herein incorporated by reference.

What is claimed is:

1. An image developer, comprising:

a developer container configured to contain a developer for developing a latent image on a latent image bearer;

a developer bearer configured to bear the developer, located close to or contacting the latent image bearer; and a developer feeding and collection roller configured to feed the developer onto the developer bearer and scrape the developer therefrom, rotating while pressing against the developer bearer, wherein the developer feeding and collection roller comprises:

an inner layer formed of a foamed rubber in which an electroconductive material is dispersed; and an outer layer formed of an insulative foamed rubber, and wherein the following relationship is satisfied:

$$\alpha \geqq T$$

wherein α represents a compression amount produced by the pressure of the developer feeding and collection roller on the developer bearer and T represents a thickness of the outer layer, and wherein an offset voltage having a polarity opposite to that of the developer when charged is applied to the developer feeding and collection roller.

2. The image developer of claim 1, wherein the insulative foamed rubber forming the outer layer of the developer feeding and collection roller has a structure that contacts the inner layer of the developer feeding and collection roller.

3. The image developer of claim 2, wherein the outer layer is a foamed polyurethane.

4. The image developer of claim 1, wherein the electroconductive foamed rubber forming the inner layer of the developer feeding and collection roller has a structure that is independent of the outer layer of the developer feeding and collection roller.

5. The image developer of claim 1, wherein a DC voltage overlapped with an AC voltage is applied to the developer feeding and collection roller.

6. The image developer of claim 1, wherein the developer feeding and collection roller has an ASKER C hardness of from 8 to 30°.

7. An image forming apparatus, comprising:

an image bearer configured to bear a latent image;

a charger configured to charge the image bearer;

an irradiator configured to irradiate the image bearer to form an electrostatic latent image thereon;

the image developer configured to form a toner image on the image bearer, according to claim 1;

a transferer configured to transfer the toner image directly or through an intermediate transferer onto a recording member; and a cleaner configured to remove residual toner remaining on the image bearer.

8. A process cartridge detachable from image forming apparatus, comprising:

an image bearer configured to bear a latent image; and the image developer according to claim 1.

9. An image forming apparatus, comprising the process cartridge according to claim 8.

10. The image developer of claim 1, wherein the outer layer of the developer feeding and collection roller is in direct contact with the inner layer of the developer feeding and collection roller.

11. The image developer of claim 1, wherein the inner layer of the developer feeding and collection roller is formed of a foamed polyurethane rubber.

* * * * *